US011041611B2

(12) United States Patent
Chang et al.

(10) Patent No.: US 11,041,611 B2
(45) Date of Patent: Jun. 22, 2021

(54) LIGHTING UNIT MOUNTING ASSEMBLY AND METHOD

(71) Applicant: ABL IP Holding LLC, Atlanta, GA (US)

(72) Inventors: Eric Chang, Buford, GA (US); Jeffrey Chase Carpenter, Atlanta, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/501,485

(22) Filed: Oct. 28, 2019

(65) Prior Publication Data

US 2021/0123587 A1 Apr. 29, 2021

(51) Int. Cl.
*F21V 21/30* (2006.01)
*F21S 8/00* (2006.01)

(52) U.S. Cl.
CPC ..... *F21V 21/30* (2013.01); *F21S 8/03* (2013.01)

(58) Field of Classification Search
CPC ..... F21V 21/26; F21V 21/045; F21V 21/046; F21S 8/036; F21S 8/028
See application file for complete search history.

(56) References Cited

U.S. PATENT DOCUMENTS 6,371,621 B1 * 4/2002 Le Bel ..... F21S 8/02 362/20
8,570,723 B2 * 10/2013 Myerchin ..... F16M 11/10 361/679.05
9,551,453 B2 1/2017 Walters
2007/0023599 A1 * 2/2007 Fedewa ..... F16M 11/10 248/284.1
2015/0336495 A1 * 11/2015 Maslakow ..... B60N 3/00 224/401
2016/0290612 A1 * 10/2016 Badley ..... F21V 17/10
2018/0252357 A1 * 9/2018 Kahn ..... F16M 13/02
2020/0081483 A1 * 3/2020 Laurent ..... G06F 1/1601

OTHER PUBLICATIONS

U.S. Appl. No. 16/794,364 , Non-Final Office Action, dated Nov. 19, 2020, 11 pages.
U.S. Appl. No. 16/794,364, Notice of Allowance, dated Mar. 12, 2021, 10 pages.

* cited by examiner

*Primary Examiner* — Evan P Dzierzynski
(74) *Attorney, Agent, or Firm* — Kilpatrick Townsend & Stockton LLP

(57) ABSTRACT

A light fixture mounting assembly includes a surface mount, a lighting unit mount configured to engage the surface mount, and an arm connecting the surface mount to the lighting unit mount. The lighting unit mount is movable in use between a first configuration in which the lighting unit mount is disengaged from the surface mount and supported by the arm and a second configuration in which the lighting unit mount is engaged to the surface mount. Moving the lighting unit mount from the first configuration to the second configuration includes moving the lighting unit mount relative to the surface mount in a first direction to cause the surface mount and the lighting unit mount to draw closer together in a second direction that is nonparallel to the first direction.

15 Claims, 11 Drawing Sheets

LIGHTING UNIT MOUNTING ASSEMBLY AND METHOD

FIELD

Mounting assemblies for lighting units, such as wall or ceiling mounted light fixtures, lamps, luminaires, or other lighting units.

BACKGROUND

Electrical lighting units are designed to provide cost-efficient lighting solutions for commercial and residential buildings. In addition to properties related to energy consumption and initial product cost, light fixtures are design to satisfy other requirements including, for example, simple and efficient mounting to minimize labor and time required for installation while simplifying subsequent maintenance operations. In some instances, regulatory and/or governmental requirements dictate that light fixtures comply with specific requirements.

In certain situations, it may be desirable to design light fixtures with mounting systems having varying properties designed for specific purposes such as simplifying the installation process, improving the aesthetic appeal of the installed light fixture, reducing gaps due to tolerances and fit between parts, and streamlining future maintenance operations while simultaneously optimizing other factors including, for example, weight and strength.

SUMMARY

The following summary describes a few non-limiting examples of light fixture mounting assemblies and methods for installation.

In some examples, a light fixture mounting assembly includes: a surface mount; a lighting unit mount configured to engage the surface mount; and an arm connecting the surface mount to the lighting unit mount, wherein: the lighting unit mount is movable in use between a first configuration in which the lighting unit mount is disengaged from the surface mount and supported by the arm and a second configuration in which the lighting unit mount is engaged to the surface mount; and moving the lighting unit mount from the first configuration to the second configuration includes moving the lighting unit mount relative to the surface mount in a first direction to cause the surface mount and the lighting unit mount to draw closer together in a second direction that is nonparallel to the first direction.

In some examples, a light fixture mounting assembly includes: a surface mount; a lighting unit mount configured to engage the surface mount; at least one arm connecting the surface mount to the lighting unit mount; a ramp on one of the surface mount and the lighting unit mount; a first configuration in which the lighting unit mount is disengaged from the surface mount and supported by the arm; and a second configuration in which the lighting unit mount is engaged with the surface mount, wherein: the lighting unit mount is movable relative to the surface mount between the first configuration and the second configuration; movement between the first configuration and the second configuration comprises movement in a first direction, which causes the lighting unit mount and the surface mount to draw closer together in a second direction that is nonparallel with the first direction; and the ramp interacts with a portion of the other of the surface mount and the lighting unit mount as the lighting unit mount moves in the first direction such that the ramp causes the surface mount and the lighting unit mount to draw closer together in the second direction.

In some examples, a method of installing a lighting unit includes: attaching a surface mount to a surface; attaching a lighting unit to the surface mount by a hanger such that the hanger supports the lighting unit mount and such that the surface mount is not covered by the lighting unit; while the lighting unit is supported by the hanger and the surface mount is not covered by the lighting unit, making at least one electrical connection to the lighting unit; after making at least one electrical connection, moving the lighting unit to cover the surface mount and engage the lighting unit to the surface mount; and while the lighting unit is engaged to the surface mount, moving the lighting unit mount in a first direction relative to the surface mount to cause the lighting unit mount to be drawn towards the surface in a second direction that is nonparallel with the first direction.

DETAILED DESCRIPTION OF THE DRAWINGS

Figure 1:
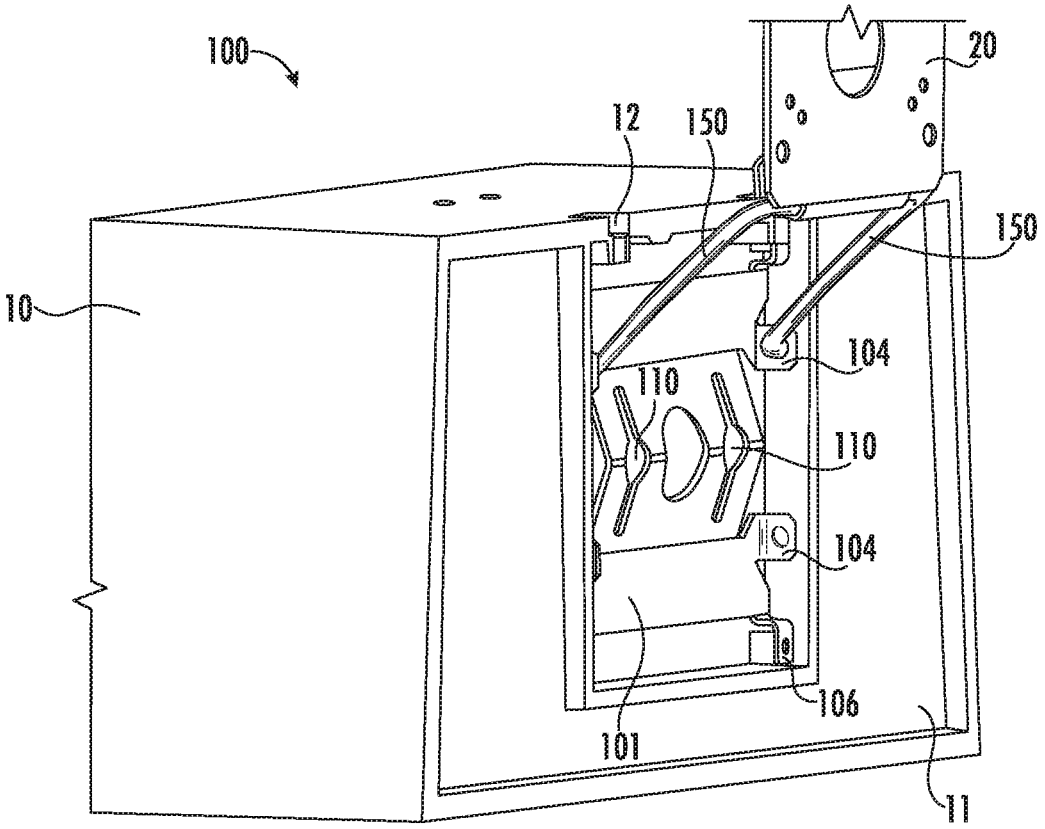
FIG. 1 shows an example of a mounting assembly for a lighting unit.

FIGS. 1-8C illustrate two non-limiting examples of mounting assemblies 100, 200 for light fixtures 10. FIGS. 1-3C show a mounting assembly 100 including a lighting unit mount 101 and a surface mount 20 connected to the lighting unit mount 101 by a hanger 150 and a plate 30. FIGS. 4-8C show a mounting assembly 200 including a lighting unit mount 201, and a surface mount 20 connected to the lighting unit mount by a hanger 250. The mounting assembly 200 of FIGS. 4-8C also includes a plate 30 to connect the hanger 250 to the surface mount 20.

Figure 5:
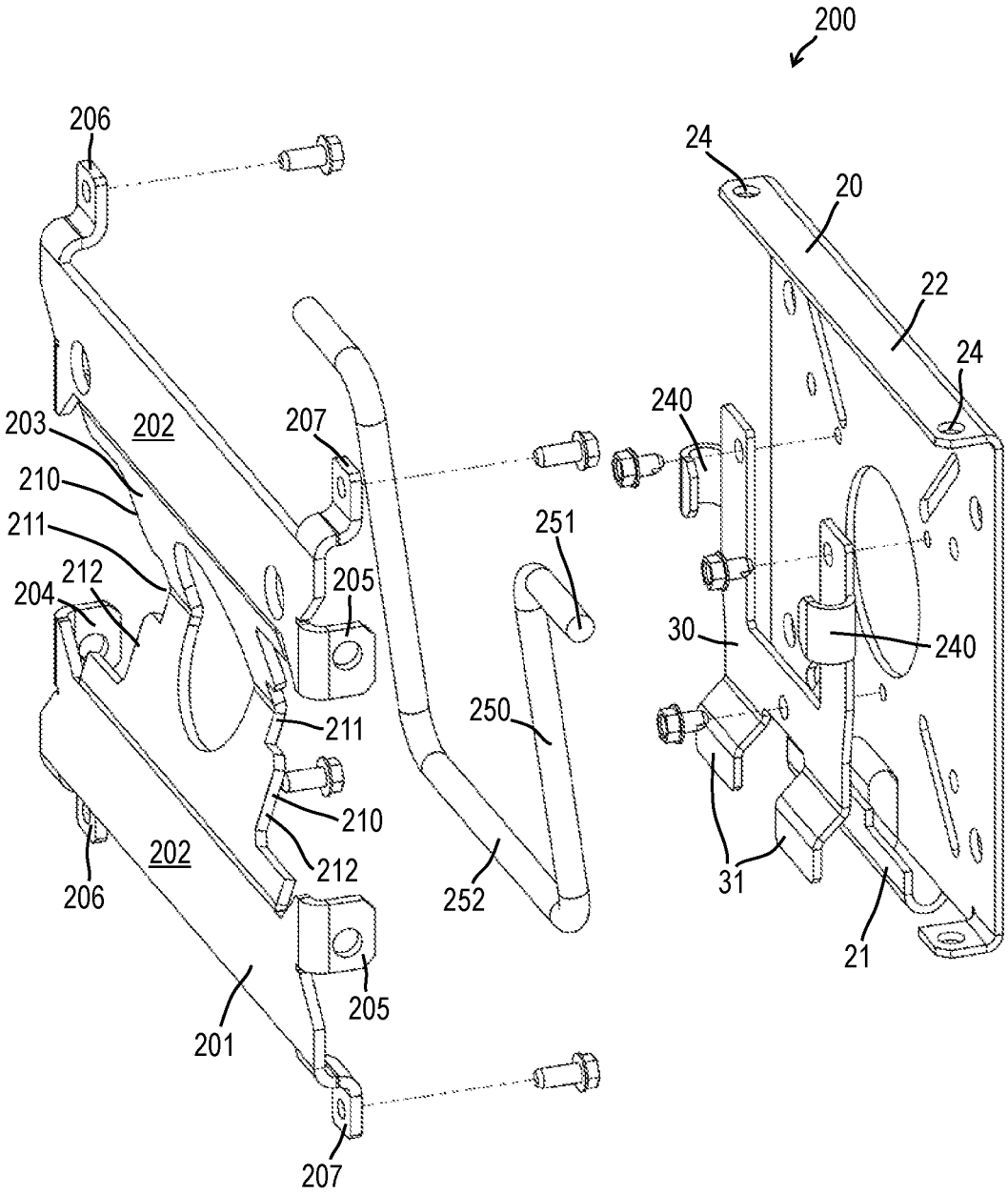
FIG. 5 shows the mounting assembly of FIG. 4 disassembled.
Figure 6:
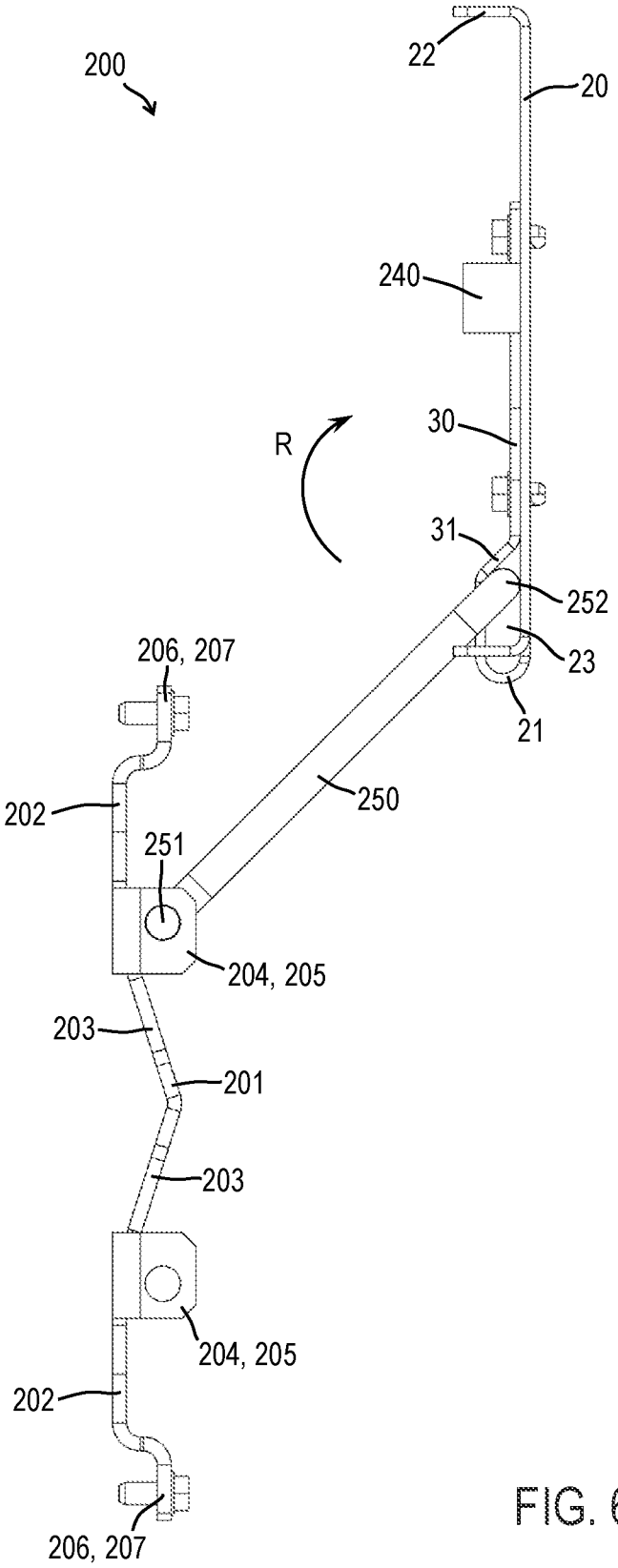
FIG. 6 shows the mounting assembly of FIG. 4 in a disengaged configuration.

The lighting unit mount 101, 201 may be an integral component of the light fixture 10, may be a separate plate attached to the light fixture 10, or any other appropriate configuration. The surface mount 20 includes several holes for receiving fasteners (screws, nails, etc.) allowing the surface mount to be mounted to a wall, ceiling, or other surface. In these specific examples, the hanger 150, 250 is a rigid arm 150, 250, although other types of rigid or non-rigid hangers could be utilized instead. The arm 150, 250 shown in the figures includes a first end 151, 251 attached to the lighting unit mount 101, 201 and a second end 152, 252 attached to the surface mount 20. In the figures, the single arm 150, 250 has a U shape. Alternatively, the arm may have other shapes or may be replaced with multiple arms. The second end 152, 252 of the arm 150, 250 may be attached near a lower portion 21 of the surface mount 20, such as within opening 23 (see FIGS. 3A-3C, 6, and 8A-8C). In some embodiments, as shown in FIGS. 3A-3C and 8A-8B, the lower portion 21 of the surface mount 20 includes an open loop that forms an opening 23. In certain embodiments, as shown in FIGS. 5-6, a plate 30 is attached to the surface mount 20 and includes at least one lower portion 31 that corresponds and/or interfaces with lower portion 21 of the surface mount 20 to enclose the opening 23. In other words, the second end 152, 252 of the arm 150, 250 may be located within the opening 23 and then the plate 30 can be attached to secure the second end 152 within the opening 23. In some embodiments, an upper end 22 of the surface mount 20 may include a connection 24 (e.g., a threaded hole) that aligns with a connection feature 12 of the light fixture 10. A fastener may be inserted through the connection feature 12 to engage the connection 24 to act as a security feature to prevent inadvertent or unauthorized movement of the lighting unit mount 101, 201 and the light fixture 10 from the surface mount 20.

FIGS. 1-3C

The lighting unit mount 101 is configured to be attached to the light fixture 10 (while separate from the at least one arm 150) and the surface mount 20 along with the at least one arm 150 is attached to the mounting structure (e.g., a wall or other surface). As described above, in other embodiments, the lighting unit mount 101 is an integral component of the light fixture 10. When the light fixture 10 is ready to be installed, the first end 151 of the at least one arm 150 may be attached to the mounting brackets 104, 105 of the lighting unit mount 101. The mounting assembly 100 may be arranged in a disengaged configuration where the at least one arm 150 is rotated about its second end 152 such that the lighting unit mount 101 is located below the surface mount 20 (similar to the configuration shown in FIGS. 1 and 6). The disengaged configuration allows an installer to access the attachment between the at least one arm 150 and the mounting brackets 104 of the lighting unit mount 101. In addition, once the at least one arm 150 is connected to the lighting unit mount 101, the installer can complete the installation of the light fixture including, for example, all electrical connections for the light fixture (e.g., electrical power, grounds, and/or data for relevant sensors). As explained in greater detail below, to move from the disengaged configuration to the engaged configuration, the lighting unit mount 101 and the light fixture 10 are pivoted about the second end 152 of the at least one arm 150. For future maintenance operations, the mounting assembly 100 can be moved back to the disengaged configuration.

Figure 2:
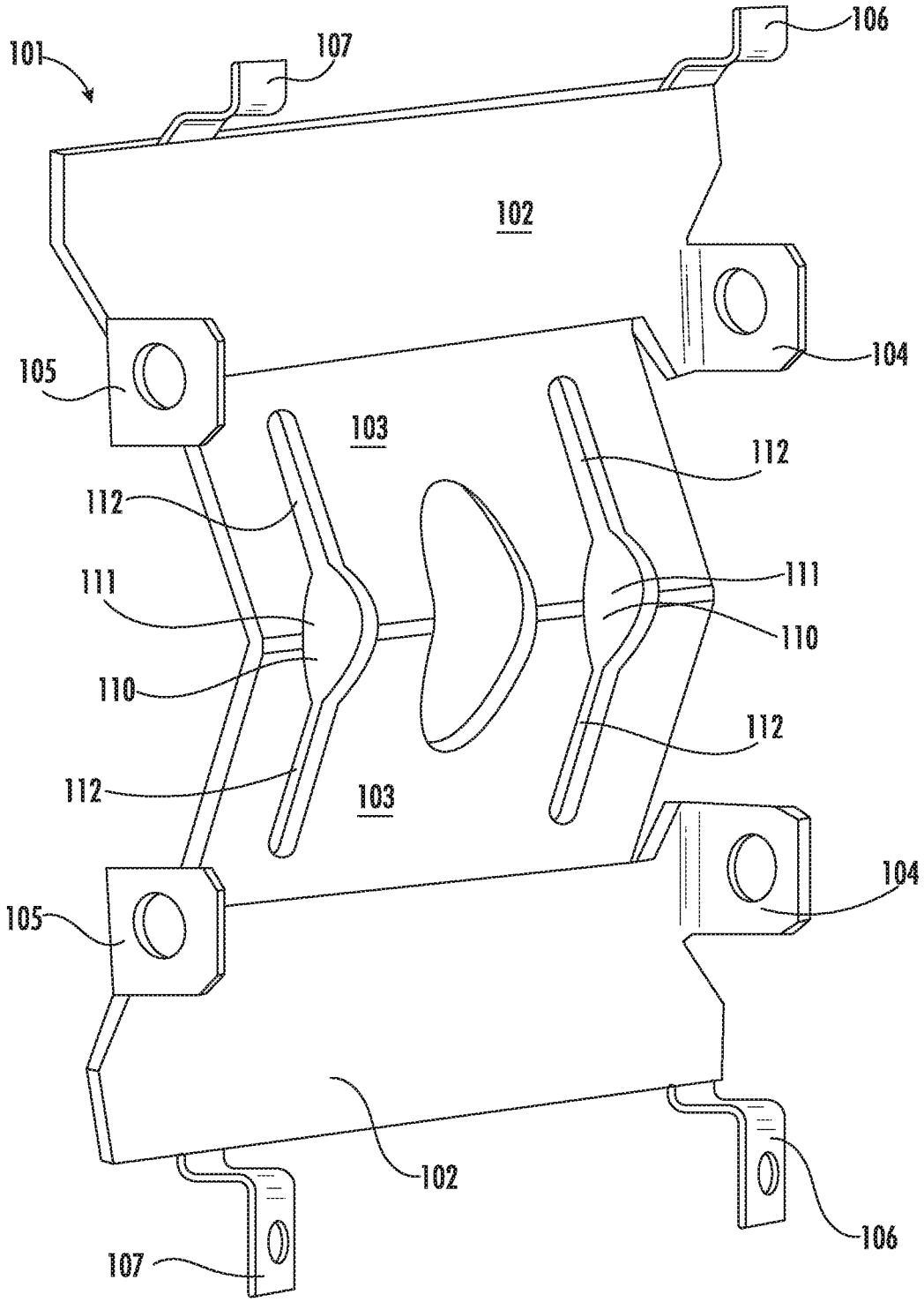
FIG. 2 shows the lighting unit mount of the mounting assembly of FIG. 1.

As shown in the example shown in FIGS. 1 and 2, the lighting unit mount 101 includes at least one first portion 102 and at least one ramp 103 that is non-parallel relative to the first portion(s) 102. The ramp(s) 103 may be a curved/contoured surface and/or may be a planar surface that is oblique relative to the first portion(s) 102. In this example, the lighting unit mount 101 is symmetric about a central horizontal plate such that the lighting unit mount 101 includes an upper first portion 102 and an upper ramp 103 that are symmetric with a lower first portion 102 and a lower ramp 103. In this example, the upper ramp 103 and the lower ramp 103 intersect at the middle of the lighting unit mount 101 at a peak of the ramp. In the example shown, the lighting unit mount 101 is symmetric such that the lighting unit mount 101 can be installed in at least two different orientations as long as mounting brackets 106, 107 align with the appropriate connections in the light fixture 10 (i.e., the lighting unit mount 101 will function in multiple orientations). Once the lighting unit mount 101 is attached (via mounting brackets 106, 107) to the light fixture 10, the arm(s) 150 is/are attached to the upper mounting brackets 104, 105.

The lighting unit mount 101 includes at least one engagement feature 110. In the example shown in FIGS. 1 and 2, the engagement feature 110 is a keyhole slot. The keyhole slot 110 may include a relief 111 and at least one distal portion 112. In some embodiments, the distal portion 112 is a narrower portion 112 (see FIG. 2). The relief 111 may be located at the maximum offset from the plane defined by the first portion(s) 102 (i.e., the intersection between the upper ramp 103 and the lower ramp 103). In this example, the engagement feature 110 is designed to interface with a feature from the surface mount 20. For example, the engagement feature 110 is designed to interface with at least one engagement projection 140 from the surface mount 20 (see FIGS. 3A-3C). In some embodiments, the engagement projection 140 is a fastener.

Figure 3A:
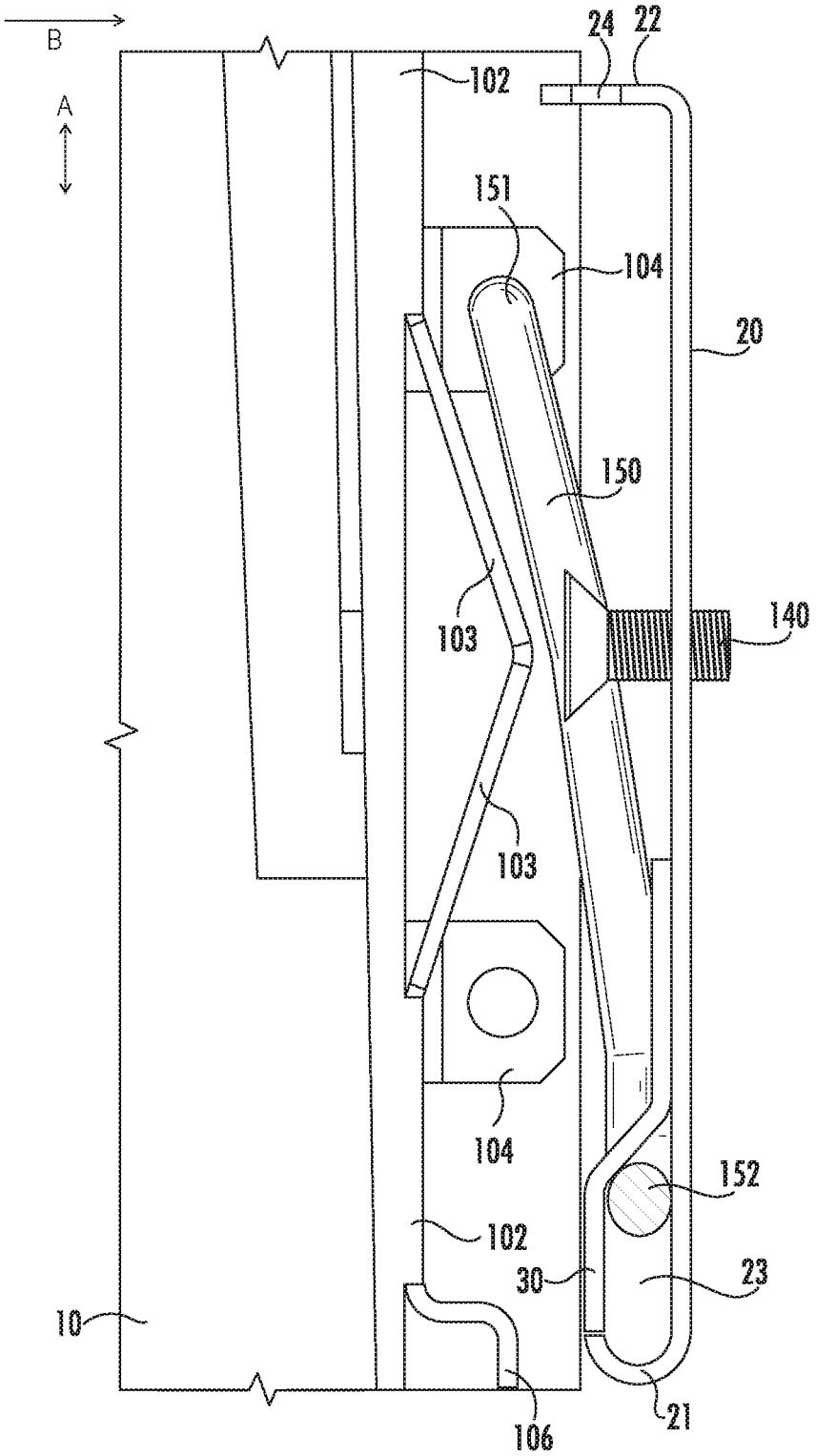
FIGS. 3A, 3B, and 3C are partial side views of the mounting assembly of FIG. 1.
Figure 3B:
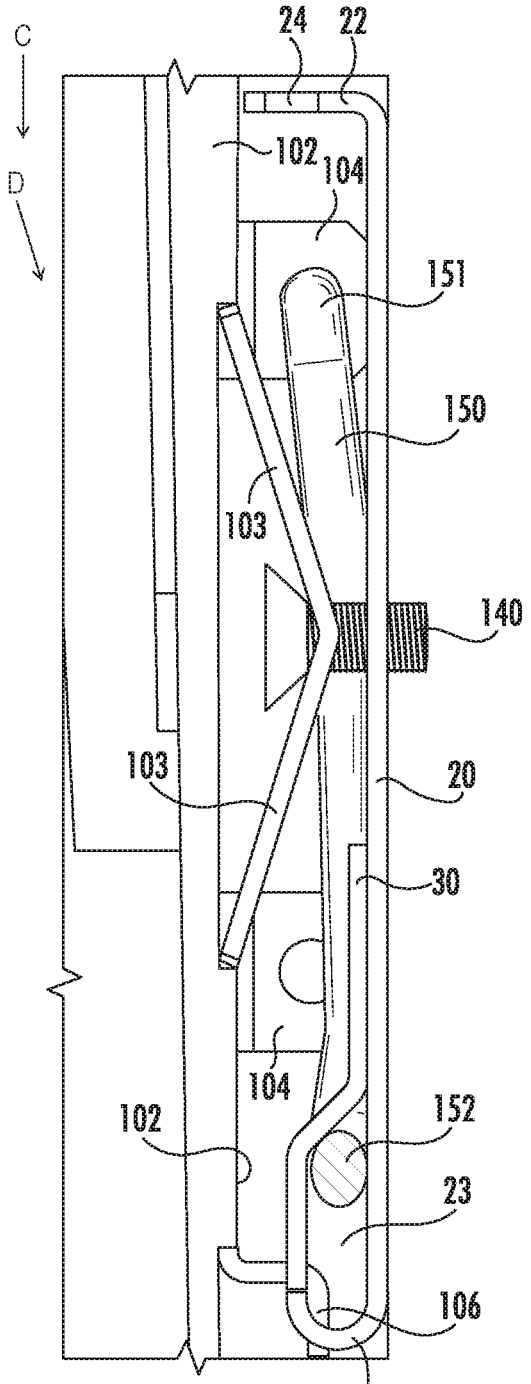
Figure 3C:
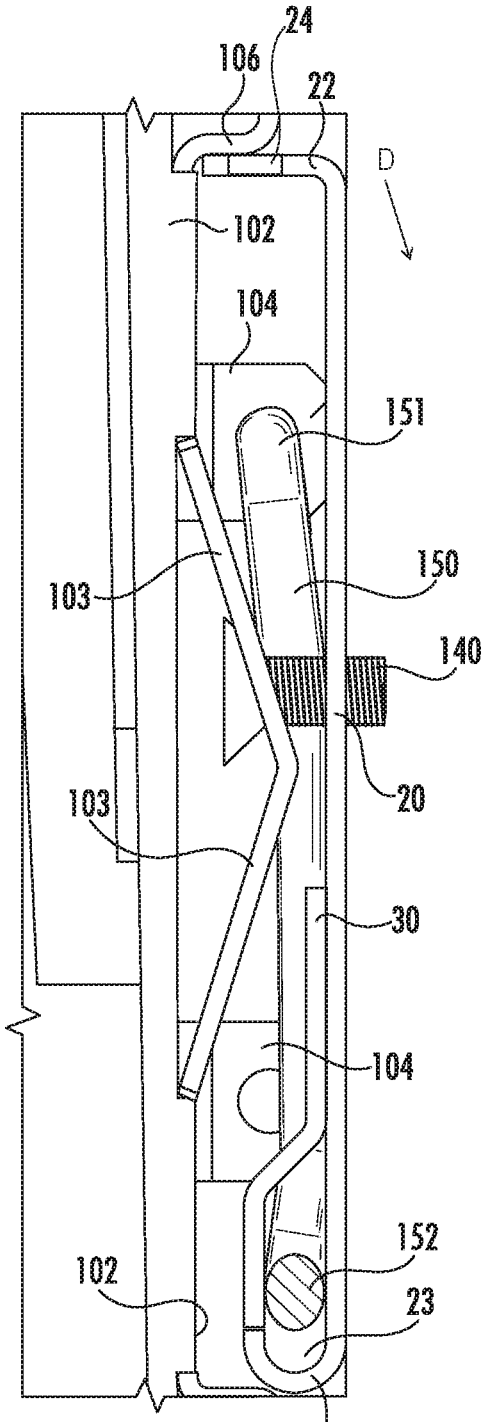

For securing the light fixture 10, the at least one engagement feature 110 and the at least one engagement projection 140 are designed to attach and engage one another without tools. As shown in FIG. 3A, the lighting unit mount 101 may be lifted/rotated up to a position adjacent to the surface mount 20. In this position, the vertical location of the lighting unit mount 101 (along with light fixture 10, if attached) can be adjusted along direction A based on translational movement of the second end 152 of the arm(s) 150 within the opening 23. The lighting unit mount 101 is adjusted such that the relief 111 is aligned with the engagement projection 140 and the lighting unit mount 101 is moved toward the surface mount 20 in direction B. FIG. 3A shows the mounting assembly 100 with the relief 111 and the engagement projection 140 aligned while FIG. 3B shows the mounting assembly 100 after the engagement projection 140 is inserted through the relief 111 (i.e., after the lighting unit mount 101 has moved toward the surface mount 20 in direction B). For embodiments where the engagement projection 140 is a fastener (as shown in FIGS. 3A-3C), the head of the fastener passes through the relief 111. After the engagement projection 140 is inserted through the relief 111, the lighting unit mount 101 (along with light fixture 10, if attached) is allowed to move in direction C (e.g., vertically downward due to gravity where the surface mount 20 is attached to a wall—see FIG. 3B) such that the engagement projection 140 moves from the relief 111 into the narrower portion 112. After some movement in direction C, the engagement projection 140 contacts a surface of ramp 103 (i.e., the head of the engagement projection 140 slides along a surface of the ramp 103). In other words, the lighting unit mount 101 (along with light fixture 10, if attached) begins moving in direction D (see FIGS. 3B and 3C), which is defined by the surface of ramp 103, to the engaged configuration. Direction D is nonparallel with direction C. Movement in a first direction (direction C) causes engagement between the engagement projection 140 and the surface of ramp 103, which results in movement in a second direction (direction D) such that the surface mount 20 and the lighting unit mount 101 draw closer together. In some embodiments, direction D includes vector components in direction B and direction C. The engaged configuration is illustrated in FIG. 3C. The head of the fastener (i.e., engagement projection 140) is larger than the size of the narrower portion 112 such that the lighting unit mount 101 and the surface mount 20 are attached to one another. In addition, due to the geometry of the ramp 103, as the engagement projection 140 moves upward through the narrower portion 112 along the ramp 103, the lighting unit mount 101 is pulled closer to the surface mount 20. This movement of the lighting unit mount 101 pulls the light fixture 10 closer to the structure (e.g., wall or other surface).

In some cases, the gaps between the light fixture 10 and the structure/wall may be small, which will limit the vertical movement of the engagement projection 140 within the narrower portion 112. However, due to the geometry of the engagement feature(s) 110, the mounting assembly 100 is adaptable and can adjust the location of the light fixture 10 relative to the surface mount 20 based on the movement of the engagement projection 140 within the narrower portion 112. In other words, as the engagement projection 140 moves upward in the narrower portion 112 (away from the relief 111), the lighting unit mount 101 and the light fixture 10 are drawn closer to the structure (e.g., wall or other surface).

FIGS. 4-8C

Figure 4:
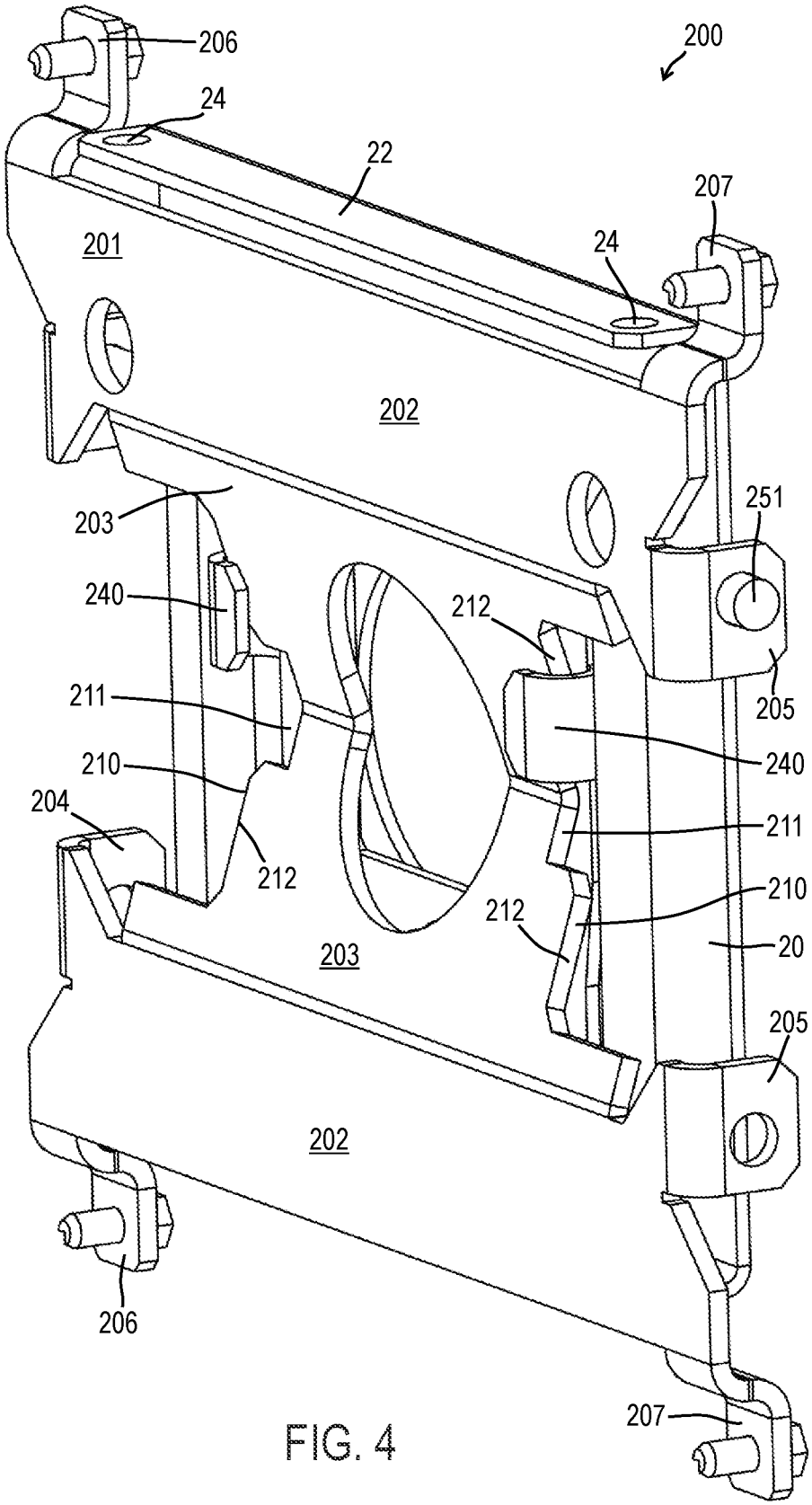
FIG. 4 shows another example of a mounting assembly, in this figure shown in an engaged configuration.

The example shown in FIGS. 4 and 5 utilizes a different engagement feature and a different engagement projection from the earlier example. FIGS. 4-8C show examples of mounting assemblies 200 that include a lighting unit mount 201 attached to a light fixture and a surface mount 20 attached to the lighting unit mount 201 by at least one arm 250. To better facilitate illustration of the features of mounting assemblies 200, the light fixture is not illustrated in FIGS. 4-8C; however, a light fixture similar to light fixture 10 (shown in FIGS. 1-3C) may be compatible with mounting assemblies 200. The at least one arm 250 includes a first end 251 attached to the lighting unit mount 201 and a second end 252 attached to the surface mount 20. The at least one arm 250 may include multiple arms that attach to different portions of the respective plates while, in other embodiments, the at least one arm 250 may be a single component that attaches to the respective plates. In some examples, the arm 250 is a closed loop or a component forming a "C" or "U" shape (e.g., see arm 250 in FIG. 5). In some embodiments, the surface mount 20 is attached to a structure (e.g., a wall or other surface). The second end 252 of the arm 250 may be attached near a lower portion 21 of the surface mount 20, such as within opening 23 (see FIGS. 6 and 8A-8C). In some embodiments, the lower portion 21 of the surface mount 20 includes an open loop that forms an opening 23. In other embodiments, a plate 30 is attached to the surface mount 20 to enclose the opening 23. In other words, the second end 252 of the arm 250 may be located within the opening 23 and then the plate 30 can be attached to secure the second end 252 within the opening 23. In some embodiments, an upper end 22 of the surface mount 20 may include a connection 24 (e.g., a threaded hole) that aligns with a connection feature of the light fixture. A fastener may be inserted through the connection feature 12 to engage the connection to act as a security feature to prevent inadvertent or unauthorized movement of the lighting unit mount 201 and the light fixture from the surface mount 20.

The lighting unit mount 201 is configured to be attached to the light fixture (while separate from the at least one arm 250) and the surface mount 20 along with the at least one arm 250 is attached to the mounting structure (e.g., a wall or other surface). As described above, in other embodiments, the lighting unit mount 201 is an integral component of the light fixture. When the light fixture is ready to be installed, the first end 251 of the at least one arm 250 is attached to the mounting brackets 204, 205 of the lighting unit mount 201. The mounting assembly 200 may be arranged in a disengaged configuration where the at least one arm 250 is rotated about its second end 252 such that, if the surface mount 20 is attached to a wall, the lighting unit mount 201 is located below the surface mount 20 (see FIG. 6). The disengaged configuration allows an installer to access the attachment between the at least one arm 250 and the mounting brackets 204 of the lighting unit mount 201. In addition, once the at least one arm 250 is connected to the lighting unit mount 201, the installer can complete the installation of the light fixture including, for example, all electrical connections for the light fixture (e.g., electrical power, grounds, and/or data for relevant sensors). As explained in greater detail below, to move from the disengaged configuration to the engaged configuration, the lighting unit mount 201 and the light fixture are pivoted about the second end 252 of the at least one arm 250 (i.e., direction R shown in FIG. 6). For future maintenance operations, the mounting assembly 200 can be moved back to the disengaged configuration.

As shown in the example shown in FIG. 4, the lighting unit mount 201 includes at least one first portion 202 and at least one ramp 203 that is non-parallel relative to the first portion(s) 202. The ramp(s) 203 may be a curved/contoured surface and/or may be a planar surface that is oblique relative to the first portion(s) 202. In this example, the lighting unit mount 201 is symmetric about a central horizontal plate such that the lighting unit mount 201 includes an upper first portion 202 and an upper ramp 203 that are symmetric with a lower first portion 202 and a lower ramp 203. In this example, the upper ramp 203 and the lower ramp 203 intersect at the middle of the lighting unit mount 201 at a peak of the ramp. In the example shown, the lighting unit mount 101 is symmetric such that the lighting unit mount 201 can be installed in at least two different orientations as long as mounting brackets 206, 207 align with the appropriate connections in the light fixture (i.e., the lighting unit mount 201 will function in multiple orientations). Once the lighting unit mount 201 is attached (via mounting brackets 206, 207) to the light fixture, the arm(s) 250 is/are attached to the upper mounting brackets 204, 205.

Figure 7A:
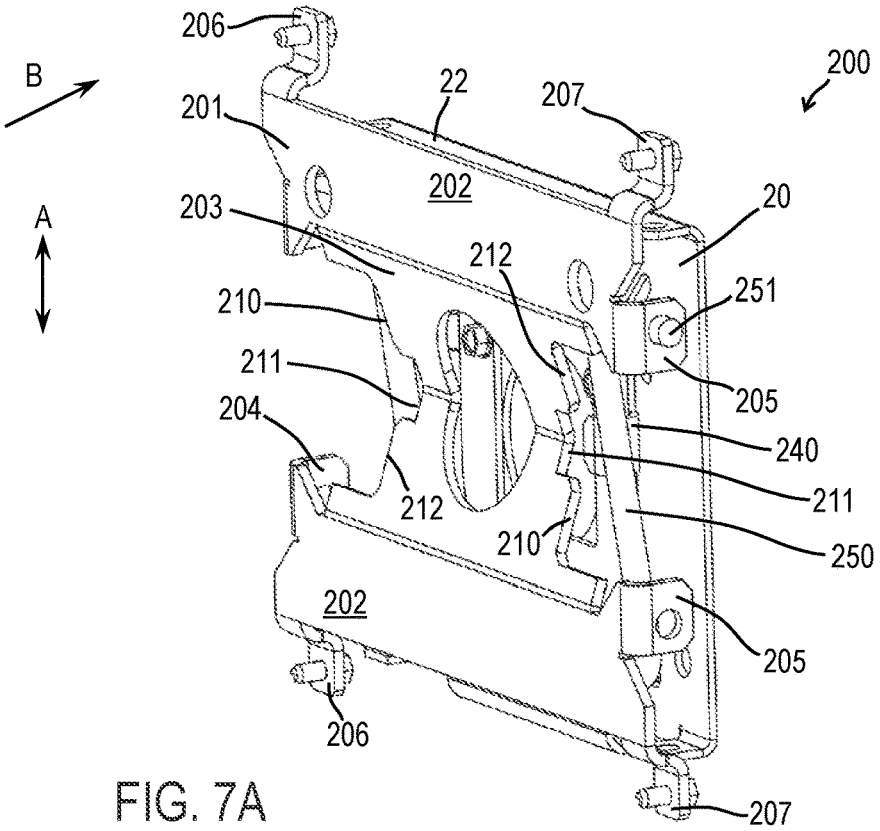
FIGS. 7A, 7B, and 7C show the mounting assembly of FIG. 4 during movement between the disengaged configuration and the engaged configuration.
Figure 7B:
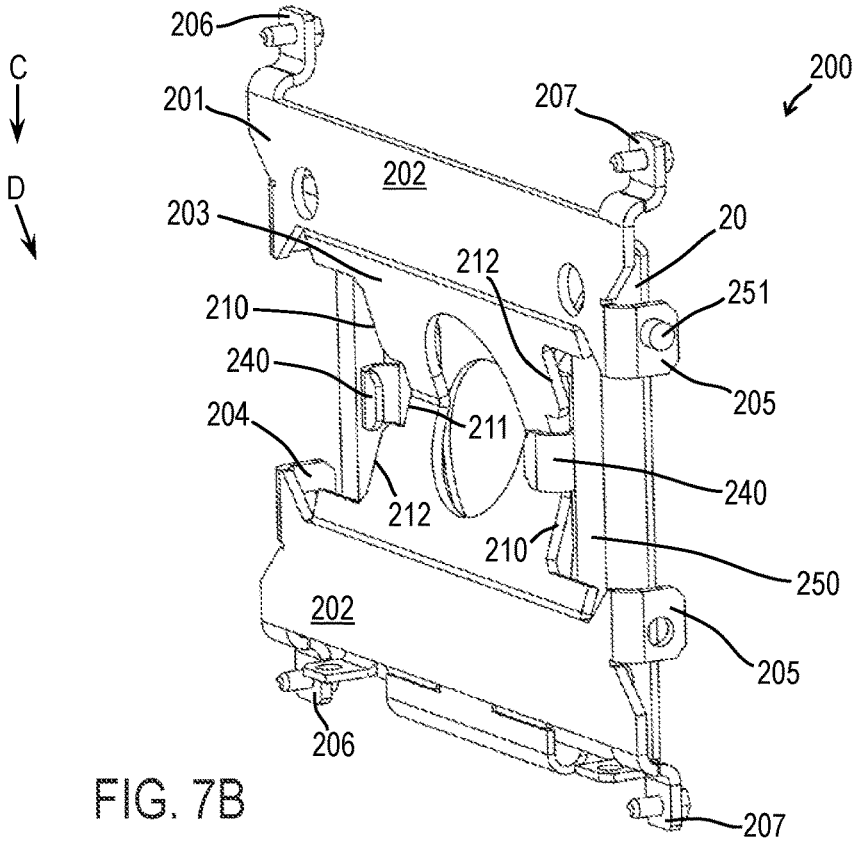

The lighting unit mount 201 includes at least one engagement feature 210. In the example shown in FIGS. 4, 5, and 7A-7C, the engagement feature 210 is a contoured edge (contrasted with the keyhole slot shown in FIGS. 1 and 2). The engagement feature 210 may include a relief 211 and at least one distal portion 212. In some embodiments, the distal portion 212 is a wider portion 212 of the lighting unit mount 201 compared to the relief 211 (see FIG. 4). In some embodiments, the relief 211 is a feature within the contoured edge of the lighting unit mount 201. In this example, the relief 211 is located at the maximum offset from the plane defined by the first portion(s) 202 (i.e., the intersection between the upper ramp 203 and the lower ramp 203). The engagement feature 210 is designed to interface with a feature from the surface mount 20 (and/or the plate 30). For example, the engagement feature 210 may be designed to interface with at least one engagement projection 240 from the surface mount 20 and/or plate 30 (see FIGS. 4-8C). As shown in FIGS. 5 and 7B, the engagement projection 240 is a hook or a protrusion with an "L" shape (contrasted with the fastener shown in FIGS. 3A-3C). As shown in FIG. 5, the engagement projection(s) 240 may be features of the plate 30. However, in other embodiments, the engagement projection(s) 240 may be features of the surface mount 20. In some embodiments, the plate 30 is an integral component of the surface mount 20 such that the engagement projection(s) 240 are features of the surface mount 20.

Figure 7C:
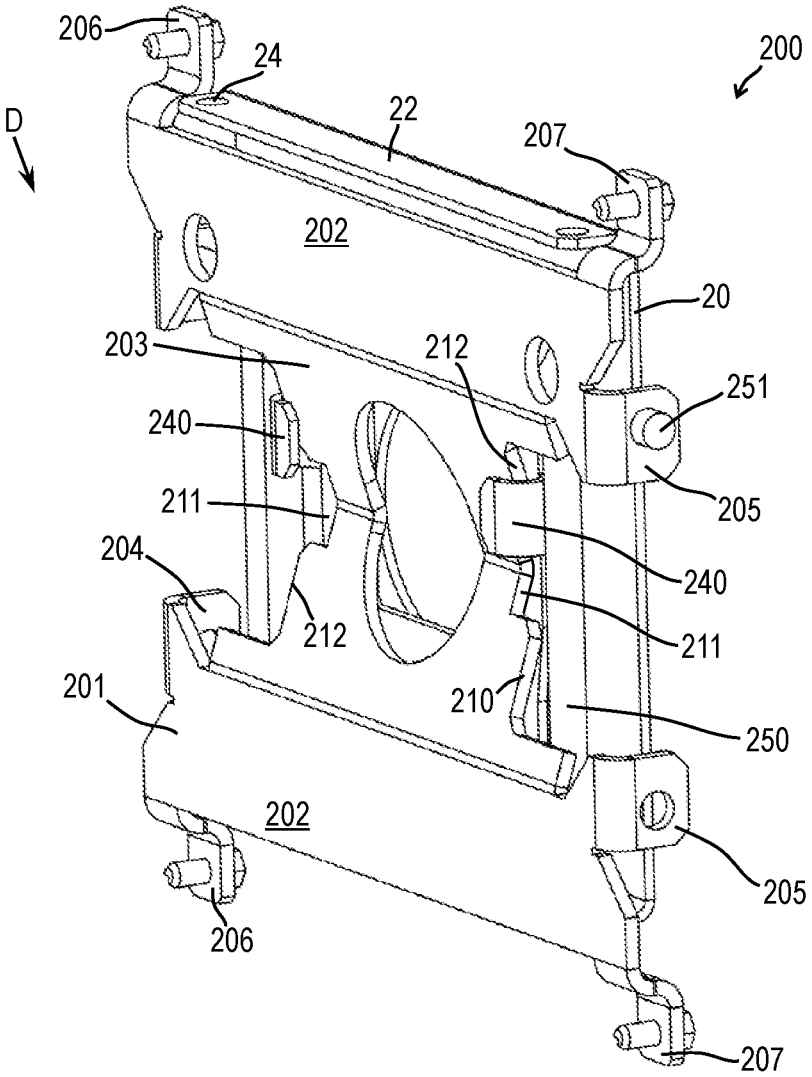
Figure 8A:
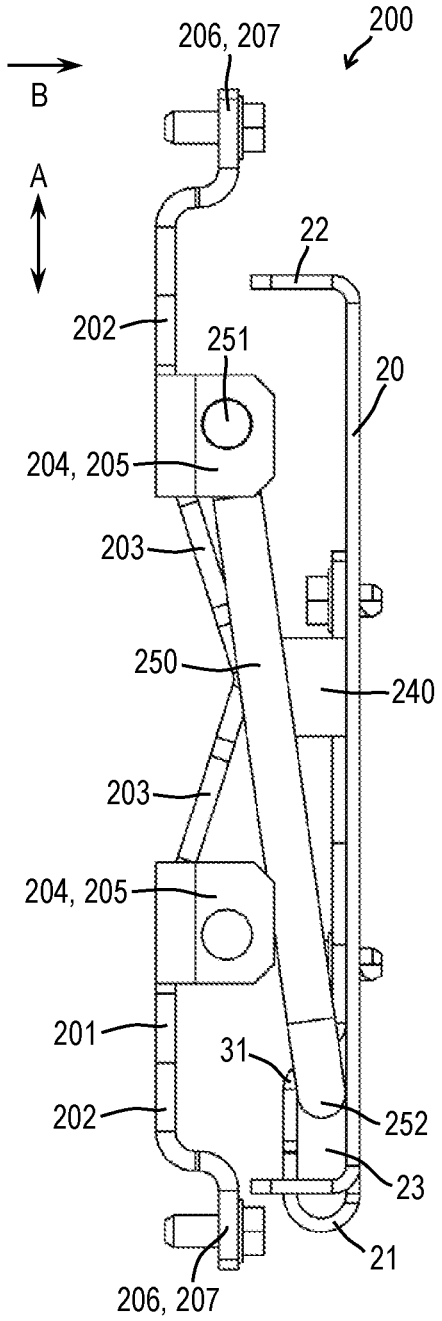
FIGS. 8A, 8B, and 8C show from the side of the mounting assembly of FIG. 4 during movement between the disengaged configuration and the engaged configuration.
Figure 8B:
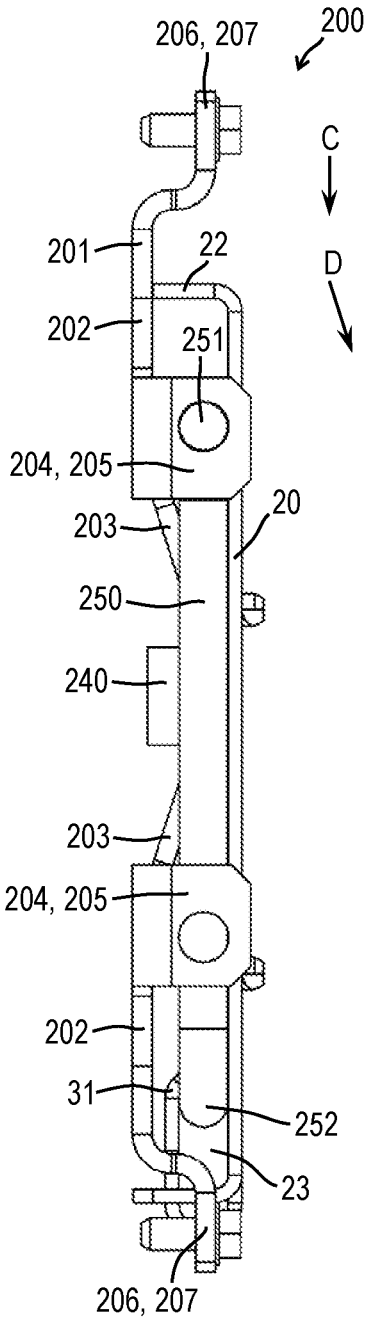
Figure 8C:
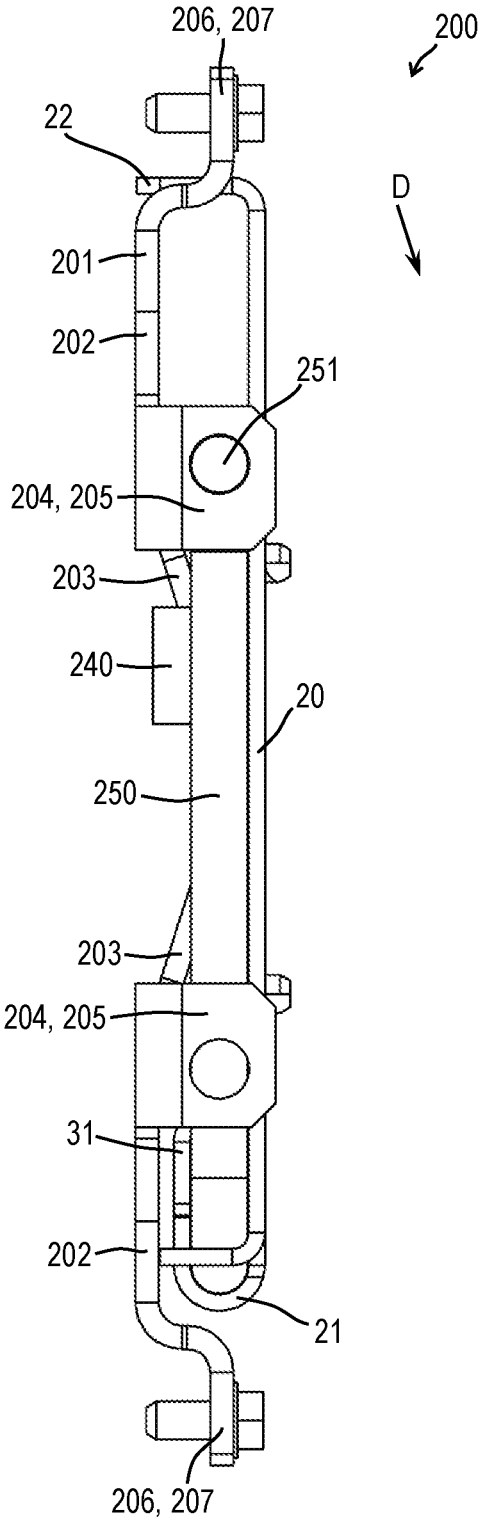

For securing the light fixture, the at least one engagement feature 210 and the at least one engagement projection 240 are designed to attach and engage one another without tools. As shown in FIGS. 7A and 8A, the lighting unit mount 201 may be lifted/rotated up to a position adjacent to the surface mount 20 (movement in direction R from the disengaged configuration shown in FIG. 6). In this position, the vertical location of the lighting unit mount 201 (along with the light fixture, if attached) can be adjusted along direction A based on translational movement of the second end 252 of the arm(s) 250 within the opening 23. The lighting unit mount 201 is adjusted such that the relief 211 is aligned with the engagement projection 240 and the lighting unit mount 201 is moved toward the surface mount 20 in direction B. FIGS. 7A and 8A show the mounting assembly 200 with the relief 211 and the engagement projection 240 aligned (i.e., the aligned configuration). FIGS. 7B and 8B show the mounting assembly 200 in the partially engaged configuration after the engagement projection 240 is inserted through the relief 211 (i.e., after the lighting unit mount 201 has moved toward the surface mount 20 in direction B). For embodiments where the engagement projection 240 is a hook or "L" protrusion (as shown in FIGS. 4-8C), the hook passes through the relief 211. After the engagement projection 240 is inserted through the relief 211, the lighting unit mount 201 (along with light fixture, if attached) is allowed to move in direction C (e.g., vertically downward due to gravity where the surface mount 20 is attached to a wall—see FIGS. 7B and 8B) such that the engagement projection 240 moves from the relief 211 along the wider portion 212 to the engaged configuration. After some movement in direction C, the engagement projection 240 contacts a surface of ramp 203 (i.e., the hook of the engagement projection 240 slides along a surface of the ramp 203). In other words, the lighting unit mount 201 (along with light fixture, if attached) begins moving in direction D (see FIGS. 7B-7C and 8B-8C), which is defined by the surface of ramp 203, to the engaged configuration. Direction D is nonparallel with direction C. Movement in a first direction (direction C) causes engagement between the engagement projection 240 and the surface of ramp 203, which results in movement in a second direction (direction D) such that the surface mount 20 and the lighting unit mount 201 draw closer together. In some embodiments, direction D includes vector components in direction B and direction C. The engaged configuration is illustrated in FIGS. 7C and 8C. The hook portion of the engagement projection 240 wraps around and engages the wider portion 212 such that the lighting unit mount 201 and the surface mount 20 are attached to one another. In addition, due to the geometry of the ramp 203, as the engagement projection 240 moves upward along the wider portion 212 following the ramp 203, the lighting unit mount 201 is pulled closer to the surface mount 20. This movement of the lighting unit mount 201 pulls the light fixture closer to the structure (e.g., wall or other surface).

In some cases, the gaps between the light fixture and the structure/wall may be small, which will limit the vertical movement of the engagement projection 240 along the wider portion 212. However, due to the geometry of the engagement feature(s) 210, the mounting assembly 200 is adaptable and can adjust the location of the light fixture relative to the surface mount 20 based on the movement of the engagement projection 240 along the wider portion 212. In other words, as the engagement projection 240 moves upward along the wider portion 212 (away from the relief 211), the lighting unit mount 201 and the light fixture are drawn closer to the structure (e.g., wall or other surface).

Example Method of Use

In some examples, a method for installing the mounting assembly 100, 200 may include the following steps. The surface mount 20 is mounted to a structure (e.g., a wall or other surface). The lighting unit mount 101, 201 may be attached to a light fixture 10 using fixture mounting brackets 106, 107, 206, 207. The first end(s) 151, 251 of the at least one arm 150, 250 may be inserted into the upper mounting brackets 104, 105, 204, 205 of the lighting unit mount 101, 201. The second end 152, 252 of the arm(s) 150, 250 is inserted into the opening 23 of the surface mount 20 and then secured within this opening 23 by attaching plate 30 to enclose the opening 23. The insertion and capture of second end 152 at the opening 23 can occur before or after the first end(s) 151, 251 are attached to the mounting tabs. After each end of the arm(s) 150, 250 are secured, the mounting assembly 100, 200 can be positioned in the disengaged configuration (see FIGS. 1 and 6). Installation and maintenance operations can occur while the mounting assembly 100, 200 is in the disengaged configuration because the rear side of the light fixture 10 and the portion of the structure/wall typically hidden (when the assembly is in engaged configuration) are both accessible.

To move from the disengaged configuration toward the engaged configuration, the lighting unit mount 101, 201 (along with light fixture 10, if attached) is lifted up such that the lighting unit mount 101, 201 rotates in direction R (see FIG. 6) based on movement of the arm(s) 150, 250 until the arm(s) 150, 250 approach an approximately vertical orientation (see FIGS. 3A, 7A, and 8A). When the lighting unit mount 101, 201 approaches the surface mount 20, the vertical position of the lighting unit mount 101, 201 can be adjusted in direction A by moving (translating) the second end 152, 252 of the arm 150, 250 within the opening 23 of the surface mount 20. The vertical position of the lighting unit mount 101, 201 is adjusted such that the relief(s) 111, 211 of the engagement feature(s) 110 align with the engagement projection(s) 140, 240. This aligned configuration (which occurs between the disengaged configuration and the engaged configuration) is illustrated in FIGS. 3A, 7A, and 8A.

FIGS. 3B, 7B, and 8B show the next step where the lighting unit mount 101, 201 and the surface mount 20 are moved toward one another in direction B to the partially engaged configuration such that the engagement projection(s) 140, 240 pass through or directly adjacent to the relief(s) 111, 211 of the engagement feature(s) 110. Movement from the partially engaged configuration (shown in FIGS. 3B, 7B, and 8B) to the engaged configuration (shown in FIGS. 3C, 4, 7C, and 8C) including moving the lighting unit mount 101, 201 and/or the surface mount 20 in direction C relative to one another. In some embodiments, the lighting unit mount 101, 201 is attached is a light fixture and the surface mount 20 is attached to a structure (e.g., a wall or other surface). In such embodiments, the lighting unit mount 101, 201 (along with the light fixture) moved in direction C relative to the surface mount 20. After some movement in direction C, the engagement projection(s) 140, 240 engage a surface of the ramp 103, 203, which causes the lighting unit mount 101, 201 to move in direction D. As shown in FIGS. 3C, 4, 7C, and 8C, the angle of the ramp 103, 203 causes the engagement projection(s) 140, 240 to pull the lighting unit mount 101, 201 closer to the surface mount 20.

The components of the mounting assembly 100, 200 may be formed of materials including, but not limited to, aluminum, steel, titanium, carbon composite, graphite composite, polyester, nylon, plastic, thermoplastic, fabric materials, stainless steel, other plastic or polymer materials, other metallic materials, other composite materials, or other similar materials. Moreover, the components of the mounting assembly 100, 200 may be attached to one another via suitable fasteners, which include, but are not limited to, screws, bolts, rivets, or other mechanical or chemical fasteners.

In the following, further examples are described to facilitate understanding of aspects of the invention:

Example A. A light fixture mounting assembly comprising:

a surface mount;

a lighting unit mount configured to engage the surface mount; and an arm connecting the surface mount to the lighting unit mount, wherein:

the lighting unit mount is movable in use between a first configuration in which the lighting unit mount is disengaged from the surface mount and supported by the arm and a second configuration in which the lighting unit mount is engaged to the surface mount; and moving the lighting unit mount from the first configuration to the second configuration includes moving the lighting unit mount relative to the surface mount in a first direction to cause the surface mount and the lighting unit mount to draw closer together in a second direction that is nonparallel to the first direction.

Example B. The light fixture mounting assembly of Example A or any of the preceding or subsequent examples, wherein a ramp on one of the surface mount and the lighting unit mount interacts with a portion of the other of the surface mount and the lighting unit mount as the lighting unit mount and the surface mount move in the first direction relative to one another to cause the surface mount and the lighting unit mount to draw closer together in the second direction.

Example C. The light fixture mounting assembly of Example B or any of the preceding or subsequent examples, wherein:

the ramp comprises a surface of one of the surface mount and the lighting unit mount; and the surface of the ramp faces away from the other of the surface mount and the lighting unit mount.

Example D. The light fixture mounting assembly of Example C or any of the preceding or subsequent examples, wherein the ramp and the portion of the other of the surface mount and the lighting unit mount interact in a sliding fashion to cause the surface mount and the lighting unit mount to move closer to one another in the second direction.

Example E. The light fixture mounting assembly of Example D or any of the preceding or subsequent examples, wherein the portion that interacts with the ramp in a sliding fashion wraps around an edge of the ramp.

Example F. The light fixture mounting assembly of Example B or any of the preceding or subsequent examples, wherein:

the ramp comprises a relief;

the portion of the other of the surface mount and the lighting unit mount comprises an engagement projection; and moving the lighting unit mount from the first configuration to the second configuration includes passing the engagement projection through the relief Example G. The light fixture mounting assembly of Example F or any of the preceding or subsequent examples, wherein:

the ramp comprises a distal portion extending away from the relief and the engagement projection comprises a portion configured to (i) pass through the relief and (ii) engage a surface of the ramp when the light fixture mounting assembly is in the second configuration.

Example H. The light fixture mounting assembly of Example A or any of the preceding or subsequent examples, wherein the arm is connected in both a pivoting and sliding fashion to at least one of the surface mount and the lighting unit mount.

Example I. The light fixture mounting assembly of Example H or any of the preceding or subsequent examples, wherein an end of the arm slides relative to at least one of the surface mount and the lighting unit mount as the lighting unit mount and the surface mount move relative to one another in the first direction.

Example J. The light fixture mounting assembly of Example A or any of the preceding or subsequent examples, wherein the lighting unit mount is part of or attached to a light fixture and the surface mount is configured to attach to a wall or a ceiling.

Example K. A light fixture mounting assembly comprising:

a surface mount;

a lighting unit mount configured to engage the surface mount;

at least one arm connecting the surface mount to the lighting unit mount;

a ramp on one of the surface mount and the lighting unit mount;

the surface mount and the lighting unit mount configured to be placed in a first configuration in which the lighting unit mount is disengaged from the surface mount and supported by the arm; and the surface mount and the lighting unit mount configured to be placed in a second configuration in which the lighting unit mount is engaged with the surface mount, wherein moving the lighting unit mount from the first configuration to the second configuration comprises moving the lighting unit mount relative to the surface mount in a first direction such that the ramp causes the lighting unit mount and the surface mount to draw closer together in a second direction that is nonparallel with the first direction.

Example L. The light fixture mounting assembly of Example K or any of the preceding or subsequent examples, wherein:

the ramp comprises a surface of one of the surface mount and the lighting unit mount; and the surface of the ramp faces away from the other of the surface mount and the lighting unit mount.

Example M. The light fixture mounting assembly of Example L or any of the preceding or subsequent examples, wherein the ramp and a portion of the other of the surface mount and the lighting unit mount interact in a sliding fashion to cause the surface mount and the lighting unit mount to move closer to one another in the second direction.

Example N. The light fixture mounting assembly of Example M or any of the preceding or subsequent examples, wherein the portion that interacts with the ramp in a sliding fashion wraps around an edge of the ramp.

Example O. The light fixture mounting assembly of Example K or any of the preceding or subsequent examples, wherein:

the arm is connected in both a pivoting and sliding fashion to at least one of the surface mount and the lighting unit mount; and an end of the arm slides relative to at least one of the surface mount and the lighting unit mount as the lighting unit mount and the surface mount move relative to one another in the first direction.

Example P. The light fixture mounting assembly of Example K or any of the preceding or subsequent examples, wherein:

the ramp comprises a relief;

a portion of the other of the surface mount and the lighting unit mount comprises an engagement projection; and moving the lighting unit mount from the first configuration to the second configuration includes passing the engagement projection through the relief Example Q. The light fixture mounting assembly of Example P or any of the preceding or subsequent examples, wherein:

the ramp comprises a distal portion extending away from the relief; and the engagement projection comprises a portion configured to (i) pass through the relief and (ii) engage a surface of the ramp when the light fixture mounting assembly is in the second configuration.

Example R. A method of installing a lighting unit, the method comprising:

attaching a surface mount to a surface;

attaching a lighting unit mount to the surface mount by a hanger such that the hanger supports the lighting unit mount and such that the surface mount is not covered by the lighting unit;

while the lighting unit is supported by the hanger and the surface mount is not covered by the lighting unit, making at least one electrical connection to the lighting unit;

after making the at least one electrical connection, moving the lighting unit to cover the surface mount and engage the lighting unit to the surface mount; and while the lighting unit is engaged to the surface mount, moving the lighting unit mount in a first direction relative to the surface mount to cause the lighting unit mount to be drawn towards the surface in a second direction that is nonparallel with the first direction.

Example S. The method of Example R or any of the preceding or subsequent examples, wherein moving the lighting unit to cover the surface mount includes rotating and sliding an end of the hanger relative to the surface mount, wherein the hanger comprises a rigid arm.

Example T. The method of Example R or any of the preceding or subsequent examples, wherein moving the lighting unit mount in the first direction relative to the surface mount includes sliding a ramp on one of the surface mount and the lighting unit mount along a portion of the other of the surface mount and the lighting unit mount.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

The invention claimed is:

1. A light fixture mounting assembly comprising:

a surface mount;

a lighting unit mount configured to engage the surface mount; and an arm connecting the surface mount to the lighting unit mount, wherein:

the lighting unit mount is movable in use between a first configuration in which the lighting unit mount is disengaged from the surface mount and supported by the arm and a second configuration in which the lighting unit mount is engaged to the surface mount; and moving the lighting unit mount from the first configuration to the second configuration includes moving the lighting unit mount relative to the surface mount in a first direction to cause the surface mount and the lighting unit mount to draw closer together in a second direction that is nonparallel to the first direction;

wherein a ramp on one of the surface mount and the lighting unit mount interacts with a portion of the other of the surface mount and the lighting unit mount as the lighting unit mount and the surface mount move in the first direction relative to one another to cause the surface mount and the lighting unit mount to draw closer together in the second direction.

2. The light fixture mounting assembly of claim 1, wherein:

the ramp comprises a surface of one of the surface mount and the lighting unit mount; and the surface of the ramp faces away from the other of the surface mount and the lighting unit mount.

3. The light fixture mounting assembly of claim 2, wherein the ramp and the portion of the other of the surface mount and the lighting unit mount interact in a sliding fashion to cause the surface mount and the lighting unit mount to move closer to one another in the second direction.

4. The light fixture mounting assembly of claim 3, wherein the portion that interacts with the ramp in a sliding fashion wraps around an edge of the ramp.

5. The light fixture mounting assembly of claim 1, wherein:

the ramp comprises a relief;

the portion of the other of the surface mount and the lighting unit mount comprises an engagement projection; and moving the lighting unit mount from the first configuration to the second configuration includes passing the engagement projection through the relief.

6. The light fixture mounting assembly of claim 5, wherein:

the ramp comprises a distal portion extending away from the relief; and the engagement projection comprises a portion configured to (i) pass through the relief and (ii) engage a surface of the ramp when the light fixture mounting assembly is in the second configuration.

7. A light fixture mounting assembly comprising:

a surface mount;

a lighting unit mount configured to engage the surface mount;

at least one arm connecting the surface mount to the lighting unit mount;

a ramp on one of the surface mount and the lighting unit mount;

the surface mount and the lighting unit mount configured to be placed in a first configuration in which the lighting unit mount is disengaged from the surface mount and supported by the arm; and the surface mount and the lighting unit mount configured to be placed in a second configuration in which the lighting unit mount is engaged with the surface mount, wherein moving the lighting unit mount from the first configuration to the second configuration comprises moving the lighting unit mount relative to the surface mount in a first direction such that the ramp causes the lighting unit mount and the surface mount to draw closer together in a second direction that is nonparallel with the first direction.

8. The light fixture mounting assembly of claim 7, wherein:

the ramp comprises a surface of one of the surface mount and the lighting unit mount; and the surface of the ramp faces away from the other of the surface mount and the lighting unit mount.

9. The light fixture mounting assembly of claim 8, wherein the ramp and a portion of the other of the surface mount and the lighting unit mount interact in a sliding fashion to cause the surface mount and the lighting unit mount to move closer to one another in the second direction.

10. The light fixture mounting assembly of claim 9, wherein the portion that interacts with the ramp in a sliding fashion wraps around an edge of the ramp.

11. The light fixture mounting assembly of claim 7, wherein:

the arm is connected in both a pivoting and sliding fashion to at least one of the surface mount and the lighting unit mount; and an end of the arm slides relative to at least one of the surface mount and the lighting unit mount as the lighting unit mount and the surface mount move relative to one another in the first direction.

12. The light fixture mounting assembly of claim 7, wherein:

the ramp comprises a relief;

a portion of the other of the surface mount and the lighting unit mount comprises an engagement projection; and moving the lighting unit mount from the first configuration to the second configuration includes passing the engagement projection through the relief.

13. The light fixture mounting assembly of claim 12, wherein:

the ramp comprises a distal portion extending away from the relief; and the engagement projection comprises a portion configured to (i) pass through the relief and (ii) engage a surface of the ramp when the light fixture mounting assembly is in the second configuration.

14. A method of installing a lighting unit, the method comprising:

attaching a surface mount to a surface;

attaching a lighting unit mount to the surface mount by a hanger such that the hanger supports the lighting unit mount and such that the surface mount is not covered by the lighting unit;

while the lighting unit is supported by the hanger and the surface mount is not covered by the lighting unit, making at least one electrical connection to the lighting unit;

after making the at least one electrical connection, moving the lighting unit to cover the surface mount and engage the lighting unit to the surface mount; and while the lighting unit is engaged to the surface mount, moving the lighting unit mount in a first direction relative to the surface mount to cause the lighting unit mount to be drawn towards the surface in a second direction that is nonparallel with the first direction;

wherein moving the lighting unit to cover the surface mount includes rotating and sliding an end of the hanger relative to the surface mount, wherein the hanger comprises a rigid arm.

15. A method of installing a lighting unit, the method comprising:

attaching a surface mount to a surface;

attaching a lighting unit mount to the surface mount by a hanger such that the hanger supports the lighting unit mount and such that the surface mount is not covered by the lighting unit;

while the lighting unit is supported by the hanger and the surface mount is not covered by the lighting unit, making at least one electrical connection to the lighting unit;

after making the at least one electrical connection, moving the lighting unit to cover the surface mount and engage the lighting unit to the surface mount; and while the lighting unit is engaged to the surface mount, moving the lighting unit mount in a first direction relative to the surface mount to cause the lighting unit mount to be drawn towards the surface in a second direction that is nonparallel with the first direction;

wherein moving the lighting unit mount in the first direction relative to the surface mount includes sliding a ramp on one of the surface mount and the lighting unit mount along a portion of the other of the surface mount and the lighting unit mount.

* * * * *